US005564337A

United States Patent [19]

Uehara et al.

[11] Patent Number: 5,564,337

[45] Date of Patent: Oct. 15, 1996

[54] PLATE CLAMPING APPARATUS OF PRINTING MACHINE

[75] Inventors: Kazumi Uehara; Tomoaki Iwafune, both of Nagano; Koichi Kamoi, Tokyo, all of Japan

[73] Assignees: Nagano Japan Radio Co., Ltd., Nagano; Gradco (Japan) Ltd., Tokyo, both of Japan

[21] Appl. No.: 562,894

[22] Filed: Nov. 27, 1995

[30] Foreign Application Priority Data

Nov. 29, 1994 [JP] Japan ..... 6-321589

[51] Int. Cl.[6] ..... B41F 1/30

[52] U.S. Cl. ..... 101/408; 101/415.1; 101/477; 271/204

[58] Field of Search ..... 101/408, 409, 101/410, 415.1, 477, 232, 136, 137; 271/204, 205, 206

[56] References Cited

U.S. PATENT DOCUMENTS

| | | | |
|---|---|---|---|
| 2,374,668 | 5/1945 | Davidson | 101/408 |
| 4,155,639 | 5/1979 | Bejerano et al. | 101/415.1 |
| 4,421,026 | 12/1983 | McCullion, Jr. | 101/136 |
| 5,053,826 | 10/1991 | Castelli et al. | 101/408 |
| 5,160,944 | 11/1992 | Fukumoto et al. | 101/408 |
| 5,289,768 | 3/1994 | Keller | 101/137 |
| 5,477,780 | 12/1995 | Keller | 101/137 |

FOREIGN PATENT DOCUMENTS

| | | |
|---|---|---|
| 61-104854 | 5/1986 | Japan . |
| 6-23955 | 2/1994 | Japan . |

*Primary Examiner*—Eugene H. Eickholt

*Attorney, Agent, or Firm*—Birch, Stewart, Kolasch & Birch, LLP

[57] ABSTRACT

There are provided an operating mechanism 5 having an operating portion, for example, freely rotatable roller 4, which is displaced to a setting position Ps of pressure-contacting to the plate belt 2 by a spring member 3 and a releasing position Pr spaced apart from the plate belt 2, a fore clamping mechanism 8 supported in a seasaw manner on widthwise supporting shafts 6 . . . disposed on the plate belt 2, and having clamping portions 7*c* . . . for clamping a fore portion of the plate S at one end thereof, operated portions 7*m* . . . pressed by the freely ratable roller 4 at the setting position Ps, at the other end thereof, and fore clamps 7 . . . pressed in a clamping direction by spring members 9 . . . , and a rear clamping mechanism 12 supported in a seasaw manner on a widthwise supporting shaft disposed on the plate belt 2 at a rearward of the fore clamping mechanism 8, and having a clamping portion 11*c* for clamping a rear portion of the plate S at one end thereof, operated portions 11*m* . . . pressed by the freely rotatable roller 4 located at the setting position Ps, at the other end thereof, and a rear clamp 11 pressed in a clamping direction by spring members 13 . . . . Thereby, a miniaturizing of the whole printing machine can be caused, and further a reliability and a maintainability thereof can be improved.

17 Claims, 7 Drawing Sheets

PLATE CLAMPING APPARATUS OF PRINTING MACHINE

BACKGROUND OF THE INVENTION

1. Field of the Invention

The present invention relates to a plate clamping device of a printing machine, which is used when a plate is automatically charged to a plate carrier or the plate is automatically discharged from the plate carrier.

2. Description of the Related Art

Generally, an offset printing machine is provided with a cylindrical printing drum (plate carrier), in which a plate is wound around and charged to an outer circumferential surface of the printing drum, and a fore portion and a rear portion of the plate are clamped to the printing drum by using a plate clamping apparatus.

Conventionally, with regard to this kind of clamping apparatus, there is known, for example, an original sheet locking apparatus of a printing machine, which puts an end portion of a plate between a magnet plate and a clamping plate attracted by the magnet plate, and facilitates to discharge automatically the plate, described in the official gazette of Japanese Patent Laying Open (KOKAI) No. 61(1986)-104854.

Further, as a plate clamping apparatus which is suitable to charge the plate automatically, there is known, for example, an apparatus for clamping a printing plate onto a printing drum of a printing machine, which is constituted by incorporating a mechanism for clamping automatically a plate in the printing drum, or releasing the clamping, described in the official gazette of Japanese Patent Laying Open (KOKAI) No. 6(1994)-23955.

However, there is the following problems with regard to the conventional plate clamping apparatus as well as the above exemplified plate clamping apparatus.

First, in a case where an automatic charging and an automatic discharging are intended to be realized, the constructions of the plate clamping apparatus itself or the peripheral equipment become completed, so that a large-sizing and an increasing in cost of the whole printing machine are caused.

Secondly, the apparatus such as the above plate clamping apparatus incorporated into the printing drum is inferior in reliability so that a failure due to an entering of foreign matters is apt to be caused. In addition, this apparatus has unfavorable maintainability.

SUMMARY OF THE INVENTION

It is an object, therefore, to provide a plate clamping apparatus of a printing machine, which realizes a miniaturizing and a reducing in cost of the whole printing machine.

Also, it is another object to provide a plate clamping apparatus of a printing machine in which failures are difficult to be caused, and a reliability and a maintainability can be improved.

Further, it is still another object to provide a plate clamping apparatus of a printing machine, which can clamp a plate surely and accurately onto a plate belt, even if the plate carrier is constituted by the plate belt.

In order to attain the objects, in the present invention, a plate clamping apparatus 1 of a printing machine for clamping a plate S to a surface 2*f* of a plate carrier, for example, an endless plate belt 2 hung on between a pair of pulleys 2*p* and 2*q* spaced apart from each other, is characterized by comprising an operating mechanism 5 having an operating portion, for example, freely rotatable roller 4, which is displaced to a setting position Ps of pressure-contacting to the plate belt 2 by a spring member 3 and a releasing position Pr spaced apart from the plate belt 2, a fore clamping mechanism 8 supported in a seasaw manner on widthwise supporting shafts 6 . . . disposed on the plate belt 2, and having clamping portions 7*c* . . . for clamping a fore portion of the plate S at one end thereof, operated portions 7*m* . . . pressed by the freely rotatable roller 4 at the setting position Ps, at the other end thereof, and fore clamps 7 . . . pressed in a clamping direction by spring members 9 . . . , and a rear clamping mechanism 12 supported in a seasaw manner on a widthwise supporting shafts 10 . . . disposed on the plate belt 2 in a rearward of the fore clamping mechanism 8, and having a clamping portion 11*c* for clamping a rear portion of the plate S at one end thereof, operated portions 11*m* . . . pressed by the freely rotatable roller 4 located at the setting position Ps, at the other end thereof, and a rear clamp 11 pressed in a clamping direction by spring members 13 . . . .

In this case, the fore clamping mechanism 8 is provided with a plurality of fore clamps 7 . . . supported by the supporting shafts 6 . . . positioned at an inside of the plate S from positions of left and right ends Se . . . thereof. Also, the rear clamping mechanism 12 is provided with a rear clamp 11 having a U-like portion including a pair of left and right lateral clamping members 11*x*, 11*x* and a rear clamping member 11*y*, and supported by a pair of left and right supporting shafts 10, 10 positioned at an outer side of the plate S from left and right end positions Se, Se thereof at respective lateral clamping members 11*x*, 11*x*, the rear clamping member 11y functioning as a clamping portion 11*c* being arranged rearward in a T direction in which the plate belt 2 moves.

On the other hand, a protruding clamp assisting portion 16 for bending the plate S clamped by the clamping portions 7*c* . . . is disposed on a surface 2*f* of the plate belt 2 approaching the clamping portions 7*c* . . . in a rearward of the clamping portions 7*c* . . . of the fore clamps 7 . . . .

Further, there is provided looseness preventing functioning portions 17 . . . for preventing a looseness of the plate S, furthermore, there are provided an automatic plate charging mechanism B for inserting the plate S contained in a plate tray 104 in between the clamping portion 7 of the fore clamping mechanism 8 and the plate carrier (plate belt 2), at the setting position Ps, and advancing the plate S at the same speed as that of the plate belt 2, and an automatic plate discharging mechanism C for picking up the plate S charged to the plate belt 2 to discharge the plate S at the setting position Ps.

Thereby, when the freely rotatable roller 4 of the operating mechanism 5 is displaced at the setting position Ps, the freely rotatable roller 4 is pressure-contacted to the surface 2*f* of the plate belt 2 by the spring member 3. Accordingly, in this state, when the plate belt 2 is moved in the T direction to thereby put the fore clamps 7 . . . of the fore clamping mechanism 8 into the freely rotatable roller 4, the operated portions 7*m* . . . in the fore side is put between the plate belt 2 and the freely rotatable roller 4, so that the operated portions 7*m* . . . are pressed to the freely rotatable roller 4 to thereby be displaced in a side of the plate belt 2. On this occasion, since the fore clamps 7 . . . are supported in a seesaw manner by the widthwise supporting shafts 6 . . . disposed on the plate belt 2, the clamping portion 7*c* . . . in the rearward direction is separated from the surface 2*f* of the plate belt 2.

Then, when the plate belt 2 supplied from the automatic plate charging mechanism B is inserted in between the plate belt 2 and the clamping portion 7*c* . . . , and further the plate belt 2 and the plate S are advanced at the same speed, the fore clamps 7 . . . push aside the freely rotatable roller 4 pressed by the spring member 3 to thereby pass therethrough. As a result, after the fore clamps 7 . . . pass through the freely rotatable roller 4, a fore portion of the plate S is pressed by the spring member 9 to be sandwiched between the clamping portion 7*c* and the surface 2*f* of the plate belt 2. Also, since the protruding clamp assisting portion 16 is disposed on the surface 2*f* of the plate belt 2 approaching the clamping portion 7*c* . . . in a rearward direction of the clamping portion 7*c* . . . of the fore clamps 7 . . . , the plate S clamped by the clamping portion 7*c* . . . is bent by the clamp assisting portion 16 to thereby be clamped firmly.

On the other hand, when the plate belt 2 is advanced further, the plate belt 2 is pressed to the freely rotatable roller 4 and charged to the surface 2*f* of the plate belt 2 without causing a loosening. Then, when the rear portion of the plate S approaches the freely rotatable roller 4, the rear clamp 11 of the rear clamping mechanism 12 approaches thereto also, so that the operated portions 11*m* . . . of the rear clamp 11 are sandwiched between the plate belt 2 and the freely rotatable roller 4. Thereby, the operated portions 11*m* . . . are pressed by the freely rotatable roller 4 to be displaced in a side of the plate belt 2. Since the rear clamp 11 is supported in a seesaw manner by the widthwise supporting shafts 10 . . . arranged in both left and right sides of the plate belt 2, a rear clamping portion 11*c* (rear clamping member 11*y*) is separated from the surface 2*f* of the plate belt 2. On this occasion, since the clamping portion 11*c* is rotated and displaced with the supporting shafts 10 . . . as a center, a rear end of the plate S can be entered between the clamping portion 11*c* and the supporting shafts 10 . . . , and after the rear clamp 11 passes through the freely rotatable roller 4, a rear portion of the plate S is pressed by the spring members 13 . . . , to thereby be sandwiched between the clamping portion 11*c* rotated and displaced in a forward direction and the surface 2*f* of the plate belt 2.

Therefore, the plate S is automatically charged onto the surface 2*f* of the plate belt 2, and a fore portion of the plate belt 2 is clamped by the fore clamping mechanism 8 and a rear portion of the plate belt 2 is clamped by the rear clamping mechanism 12. Then, when the freely rotatable roller 4 is displaced to the releasing position Pr at the time of the clamping step, the freely rotatable roller 4 is separated from the surface 2*f* of the plate belt 2.

Moreover, at the time of the discharging of the plate belt 2, if the freely rotatable roller 4 is pressure-contacted to the surface 2*f* of the freely rotatable roller 4 similarly to the case of the charging, the plate S is picked up by a paddle roller 55 of the automatic plate discharging mechanism C, and further a rear portion of the plate S sandwiched between the clamping portion 11*c* of the rear clamp 11 and the surface 2*f* of the plate belt 2 can be extracted by pulling the plate S.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

An optimum embodiment according to the present invention will be described hereinafter in detail with reference to the drawings.

First, in order to give a better understanding of the present invention, the whole schematic construction of an offset printing machine will be described with reference to FIGS. 5 and 6.

Figure 6:
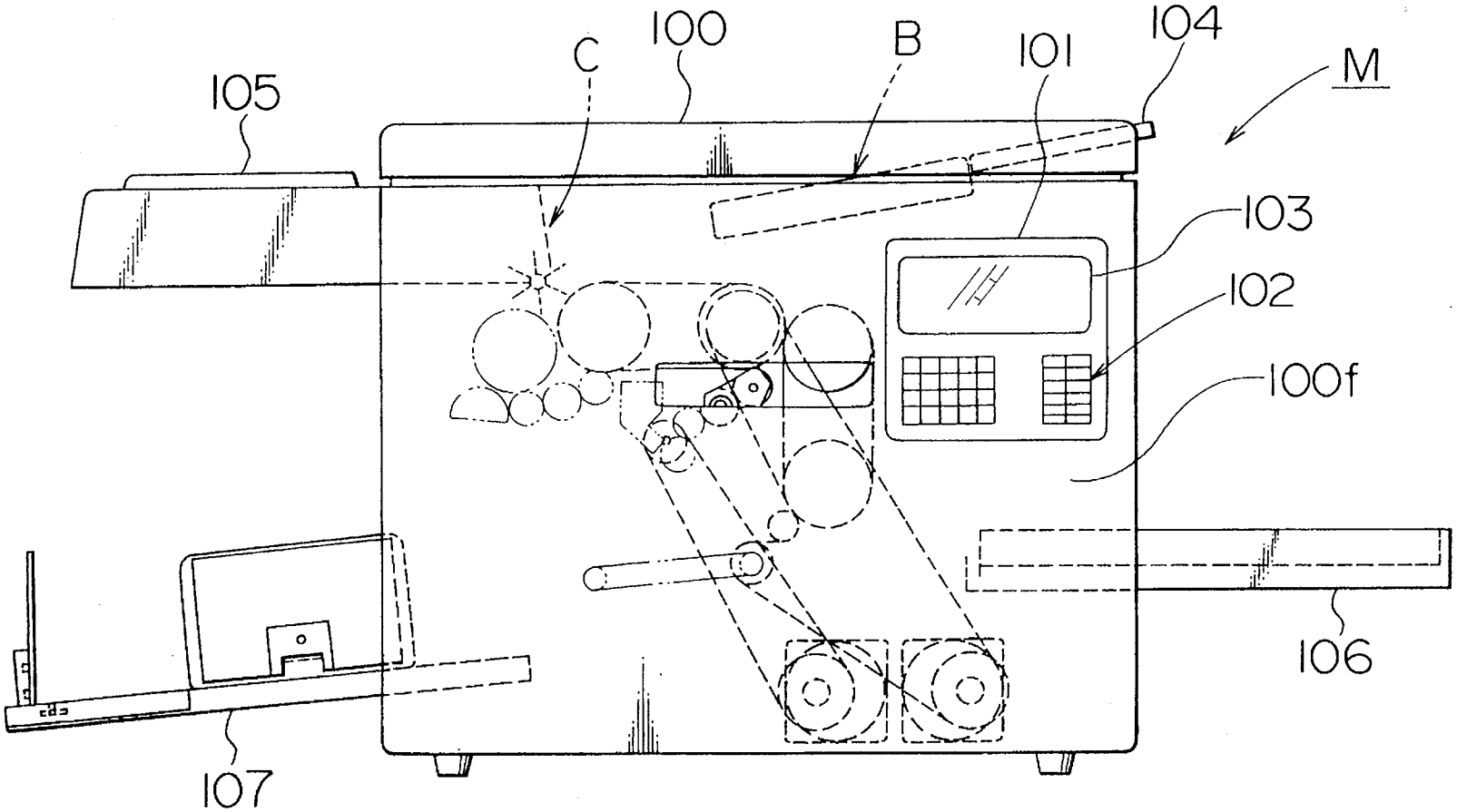
FIG. 6 is an external appearance side view of the same offset printing machine.

FIG. 6 shows an outer side appearance of the offset printing machine M according to this embodiment. Reference numeral 100 denotes a printing machine main body, which has at a case surface 100f thereof an operating panel 101 having an operating key 102 and a display 103. Also, on a rear portion of the printing machine main body 100 is arranged a plate tray 104 of the automatic plate charging mechanism B for supplying automatically the plate S, and on a fore portion thereof is arranged a plate collecting tray 105 of the automatic plate discharging mechanism C for discharging automatically the plate S. Furthermore, on a lower rear portion of the printing machine main body 100 is arranged a print sheet tray 106 for supplying the print sheet, and on a lower fore portion thereof is arranged a print sheet collecting tray 107 for collecting the printed print sheet.

Figure 5:
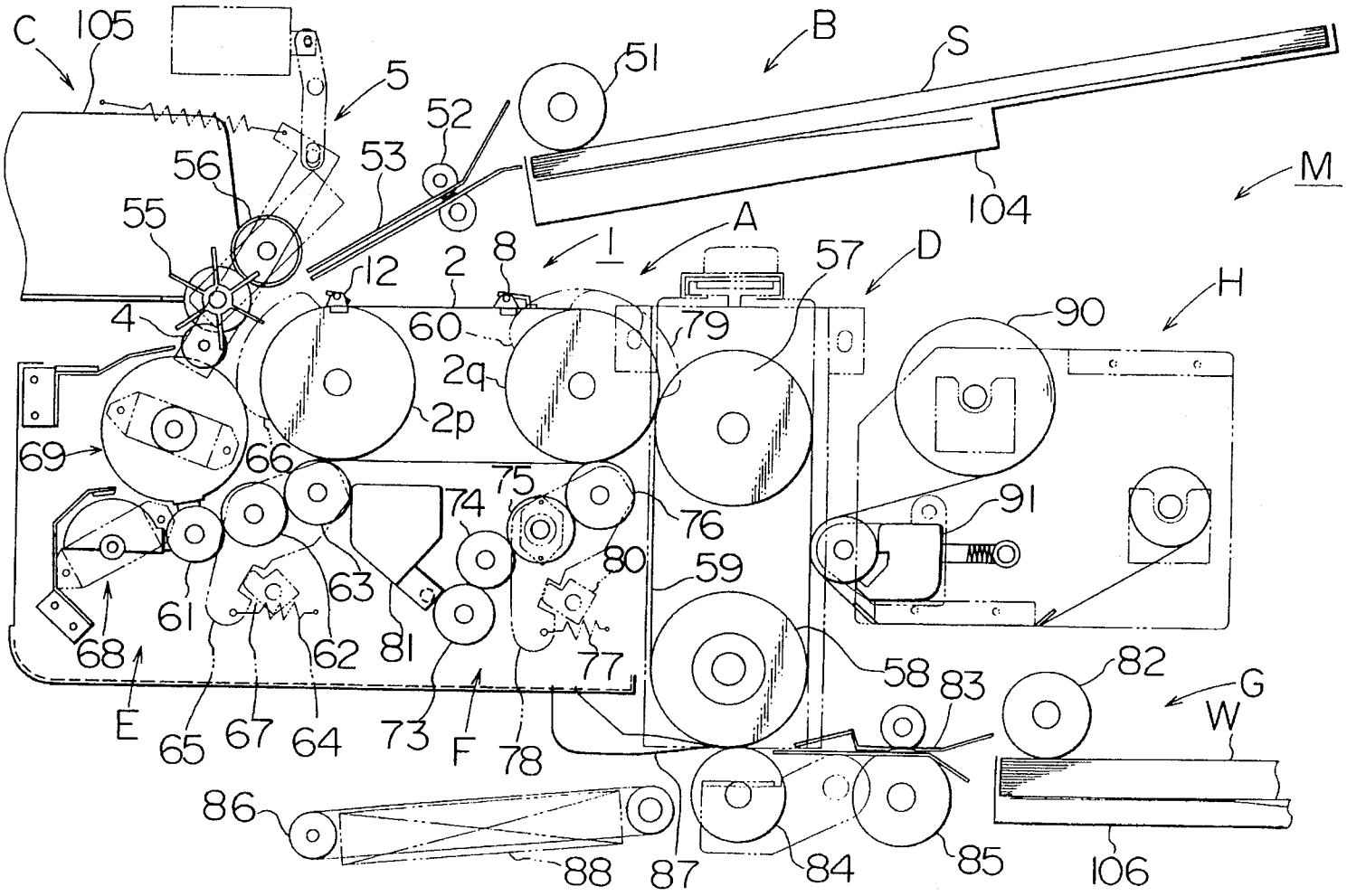
FIG. 5 is an internal constructional view of an offset printing machine provided with the same plate clamping apparatus.

On the other hand, FIG. 5 shows an inner construction of the offset printing machine M. Symbol A is a plate carrier mechanism, which is provided with an endless plate belt 2 (plate carrier) hung on between a pair of pulleys (gears) 2*p* and 2*q* spaced from each other in the horizontal direction. The plate belt 2 is a timing belt. Also, the plate carrier mechanism A is provided with a plate clamping apparatus 1 according to the present invention having a fore clamping mechanism 8 and a rear clamping mechanism 12 disposed on the plate belt 2, and an operating mechanism 5 disposed so as to oppose to the plate belt 2.

Further, symbol B denotes an automatic plate charging mechanism for supplying automatically the plates S to the plate carrier mechanism A, which comprises a plate tray 104 for containing a plurality of the plates S . . . , a separating roller 51 for separating and taking out the plates S one by one from the plate tray 104, a plate charging roller mechanism 52 for transferring the plates S taken out from the plate tray 104, and a guiding portion 53 for guiding the plates S.

Furthermore, symbol C denotes an automatic plate discharging mechanism for discharging the plates S automatically from the plate carrier mechanism A, which comprises a paddle roller 55 which is displaced in a side of the plate belt 2 at the time of the discharging to thereby pick up a front portion of the plate S disengaged from the plate clamping apparatus 1, a plate discharging roller mechanism 56 for transporting and discharging the picked up plates S, and a plate collecting tray 105 for collecting the discharged plates S.

On the other hand, symbol D denotes a blanket carrier mechanism, which comprises an endless blanket belt 59 hung on between a pair of pulleys (gears) 57 and 58 spaced apart from each other in the vertical direction. This blanket belt 59 is a timing belt. In this case, the blanket belt 59 hung on the upper pulley 57 is pressure-contacted to the plate belt 2 hung on the pulley **2*q* positioned at a rearward position of the plate carrier mechanism A, but can be displaced from an axis of the lower pulley 58 as a fulcrum, so that it is pressed by a cam 33 following a rotation of the pulley 2*q*, then separated from the plate belt 2 when the fore clamping mechanism 8 and the rear clamping mechanism 12 pass therethrough, and it is locked at a position spaced apart from the plate belt 2** by a locking mechanism (not shown) when it is not used.

On the other hand, symbol E denotes a treating liquid supplying mechanism, which comprises a first roller 61, a second roller 62 and a third roller 63 which contact in order. In this case, the third roller 33 is supported by a rotating plate 65 urged by a spring member 64 to thereby pressure-contact to a surface **2*f* of the plate belt 2, so that when the fore clamping mechanism 8 and the rear clamping mechanism 12 pass therethrough, the third roller 63 is pressed by a cam 66 following the rotation of the pulley 2*p* to thereby be separated from the plate belt 3, and when it is not used, it is locked by a locking mechanism 67 at a position spaced apart from the plate belt 2. On the other hand, an etching liquid supplying portion 68 for supplying an etching liquid to the first roller 61 and a humidifying water supplying portion 69 for supplying a humidifying water are arranged in the vicinity of the first roller 61, to thereby be adapted to supply the etching liquid or the humidifying water selectively to the first roller 61**.

Also, symbol F denotes an ink supplying apparatus, which comprises a first roller 73, a second roller 74, a third roller (laterally swinging roller) 75 and a fourth roller 76. In this case, the fourth roller 76 is supported by a rotating plate 78 urged by a spring member 77 to thereby pressure-contact to the surface **2*f* of the plate belt 2, so that when the fore clamping mechanism 8 and the rear clamping mechanism 12 pass therethrough, the fourth roller, 76 is pressed by a cam 79 following the rotation of the pulley 2*q* to thereby be separated from the plate belt 2, and when it is not used, it is locked by a locking mechanism 80 at a position spaced apart from the plate belt 2. On the other hand, the ink is supplied to the first roller 73 from an ink supplying portion 81**.

Also, symbol G denotes a printing mechanism, which comprises a print sheet tray 106 for containing a plurality of print sheets W . . . , a separating roller 82 for separating and taking out the print sheets W one by one from the print sheet tray 106, a guiding portion 83 for guiding the print sheets W taking out from the print sheet tray 106, a pressure-contacting roller 84 being capable of pressure-contacting to a surface of the blanket belt 59, a sheet supplying roller mechanism 85 for sending the print sheets W to between the pressure-contacting roller 84 and the blanket belt 59, and a transferring belt mechanism 86 for sending to a print sheet collecting tray 107 the print sheets W sent from between the pressure-contacting roller 84 and the blanket belt 59. Moreover, reference numeral 87 denotes a tearing off nozzle for supplying air to tear off the print sheets W from the blanket belt 59, and 88 is a suction unit for attracting the print sheets W to the transferring belt mechanism 86.

On the other hand, symbol H denotes a cleaning mechanism, which removes a residue ink on the blanket belt 59 by a cleaning sheet 90 such as a cloth supplied from a roll and a cleaning liquid supplied from a cleaning liquid supplying portion 91.

A construction of the plate clamping apparatus 1 according to this embodiment will be described hereinafter with reference to FIGS. 1 to 4.

Figure 2:
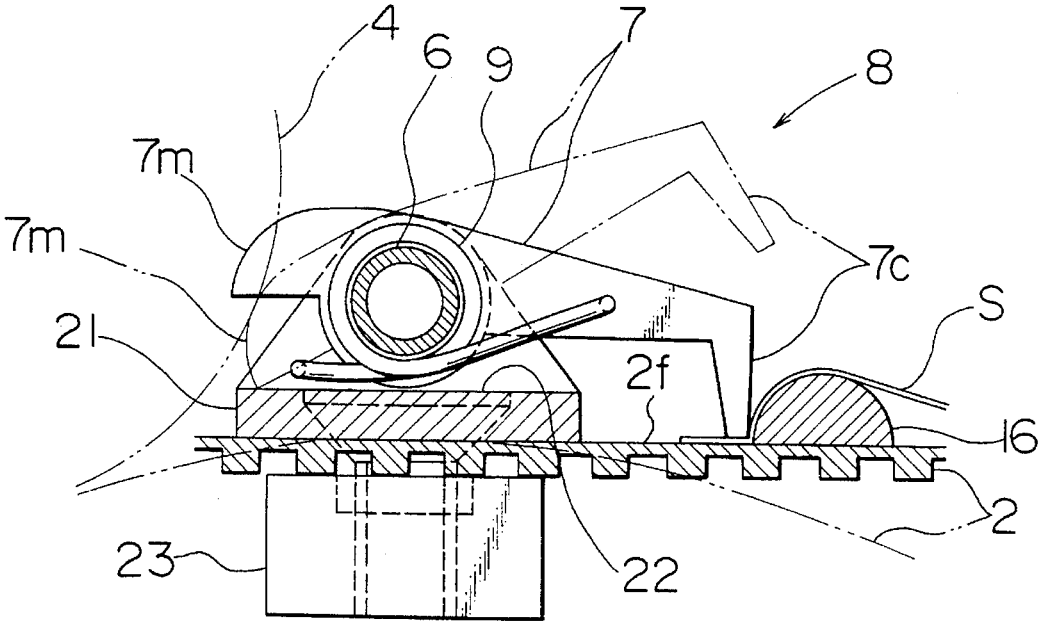
FIG. 2 is a constructional side view of a fore clamping mechanism of the same plate clamping apparatus.
Figure 4:
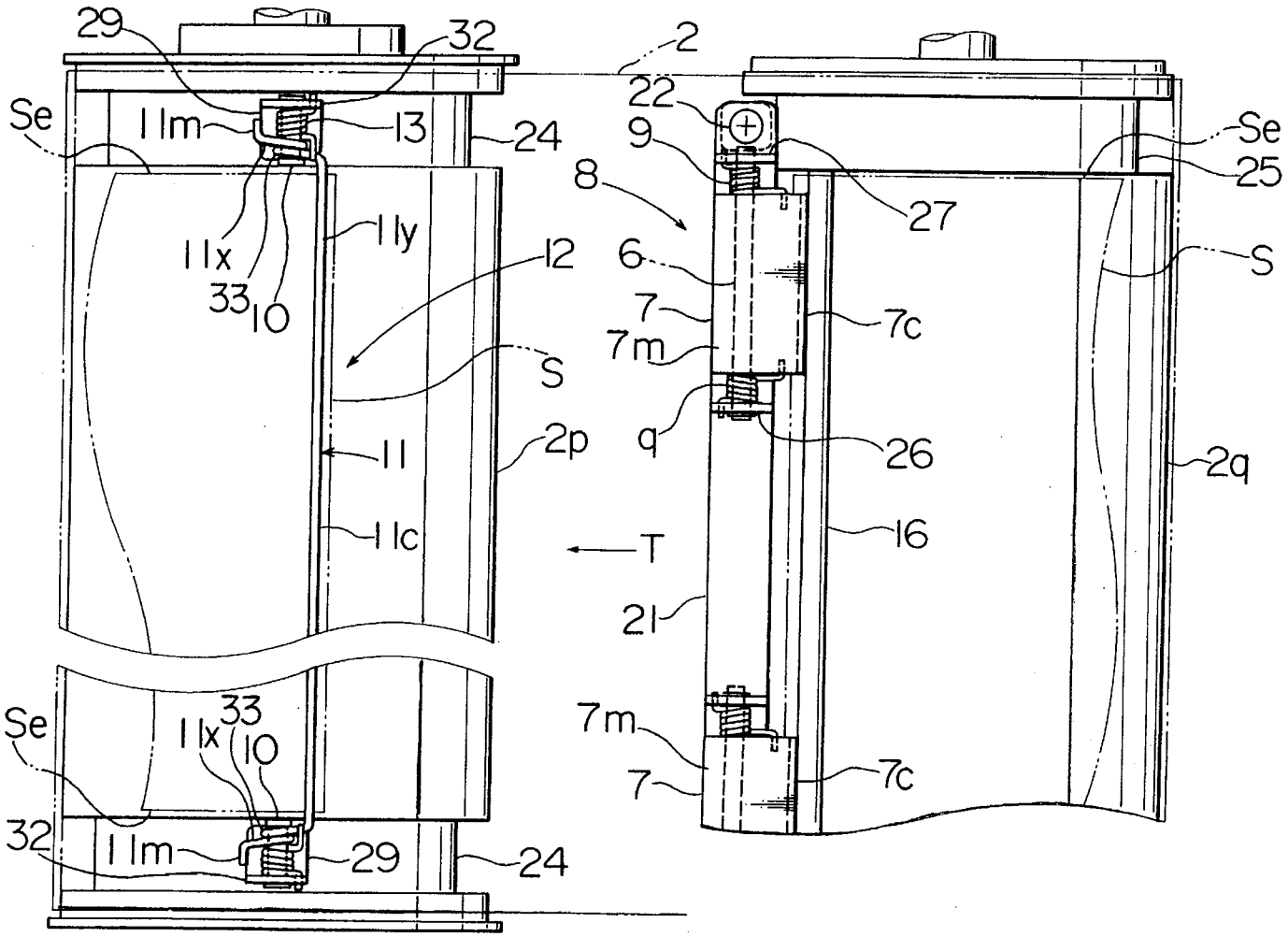
FIG. 4 is a constructional plane view of fore and rear clamping mechanisms of the same plate clamping apparatus.

First, the fore clamping mechanism 8 is disposed on the surface **2*f* of the plate belt 2. As shown in FIGS. 2 and 4, the fore clamping mechanism 8 has an elongated base plate 21 arranged in a widthwise direction of the plate belt 2, and both ends of the base plate 21 are fixed to the plate belt 2 by screws 22 . . . and nuts 23 . . . . Therefore, at both left and right ends of the pulleys 2*p* and 2*q* are disposed slit rings 24 and 25 for releasing the nuts 23** . . . .

Also, three of the fore clamps 7 . . . are arranged at a right position, a left position and a center position on an upper surface of the base plate 21. In this case, one of the fore clamps 7 is supported rotatably at an intermediate portion by the supporting shafts 6 disposed on a pair of left and right blanket portion 26 erected perpendicularly from the base plate 21. Thereby, the fore clamps 7 are supported rotatably in a seesaw manner with the supporting shafts 6 as a center, a rear side of which becomes a clamping portion **7*c*, which is formed in an L-shape viewed from a side, for clamping a fore portion of the plate S, and a fore side of which becomes a round operated portion 7*m* which is pressed by the freely rotatable roller 4 described later. Further, the spring member (coil spring) 9 is attached to the supporting shafts 6 positioned at both sides of the fore clamps 7, to thereby press it in such a direction as to pressure-contact the clamping portion 7*c* to plate belt 2. Incidentally, the other fore clamps 7 are constituted also similarly to the above. Thereby, the respective clamps 7 . . . are supported by the supporting shafts 6 . . . positioned at an inner side of the plate S from the left and right ends Se . . . thereof, as shown in FIG. 4**.

On the other hand, as shown in FIG. 2, an elongated protruding clamp assisting portion 16 in a widthwise direction for bending the plate S clamped to the clamping portion **7*c* . . . is disposed on the surface 2*f* of the plate belt 2 in the vicinity of the clamping portion 7*c* . . . in a rearward direction of the clamping portion 7*c*** . . .

Figure 3:
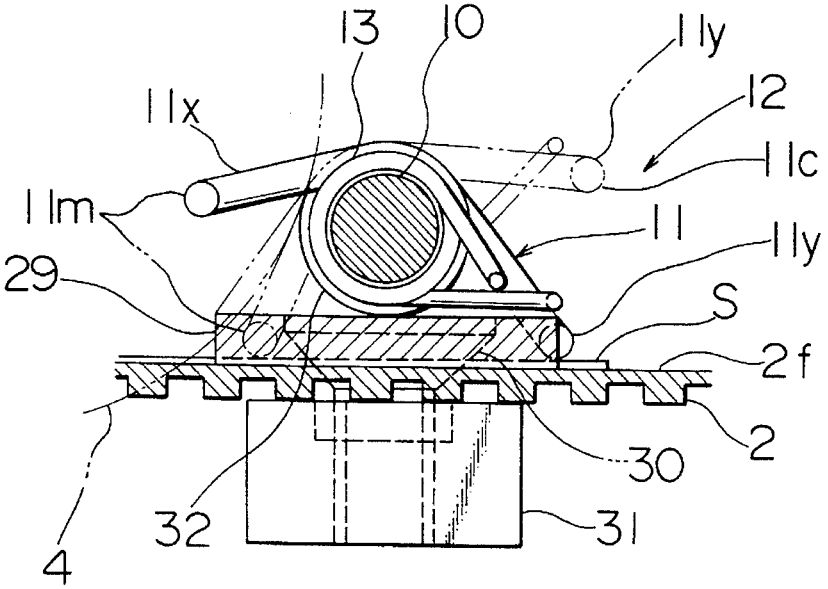
FIG. 3 is a constructional side view of a rear clamping mechanism of the same plate clamping apparatus.

Also, the rear clamping mechanism 12 is disposed on the surface **2*f* of the plate belt 2 in a rearward direction of the fore clamping mechanism 8. As shown in FIGS. 3 and 4, the rear clamping mechanism 12 is provided with a pair of the base plates 29 arranged in both left and right sides of the plate belt 2, the respective base plates 29 . . . are fixed to the plate belt 2 by screws 30 . . . and nuts 31 . . . . In this case, the nuts 31 . . . pass through inside the slit rings 24 and 25 disposed on the pulleys 2*p* and 2*q*. On the other hand, the blanket portions 32 . . . erected perpendicularly on outer end portions of the respective base plates 29 . . . and the supporting shafts 10, 10 are disposed on inner surfaces of the respective blanket portions 32, 32 . . . . Thereby, a pair of left and right supporting shafts 10, 10 are positioned on an outer side of the plate belt 2 from left and right ends Se, Se thereof. Also, the rear clamp 11 is formed by one rod, and has a U-like portion comprising a pair of left and right lateral clamping members 11***x* . . . and a rear clamping member 11*y*. Therefore, there are formed bearing portions 33 . . . in which intermediate rod portions of a pair of lateral clamping members 11*x* . . . are looped one time, and the respective supporting shafts 10 are inserted into these bearing portions 33 . . . , then the rear clamp 11 is supported rotatably by the supporting shafts 10 . . . . That is, the rear clamp 11 is supported in a seesaw manner with the supporting shafts 10 . . . as a fulcrum. Moreover, the operated portions 11*m* . . . are formed by bending leading ends of the respective clamping members 11*x* . . . at a right angle. Also, the rear clamping member 11*y* is arranged rearward in the T direction in which the plate belt 2 moves to thereby function as the clamping portion 11*c*. Further, the spring members (coil springs) 13 . . . are attached to the respective supporting shafts 10 . . . to thereby press the clamping portion 11*c* in such a direction as to provide pressure-contact to the plate belt 2.

Figure 1:
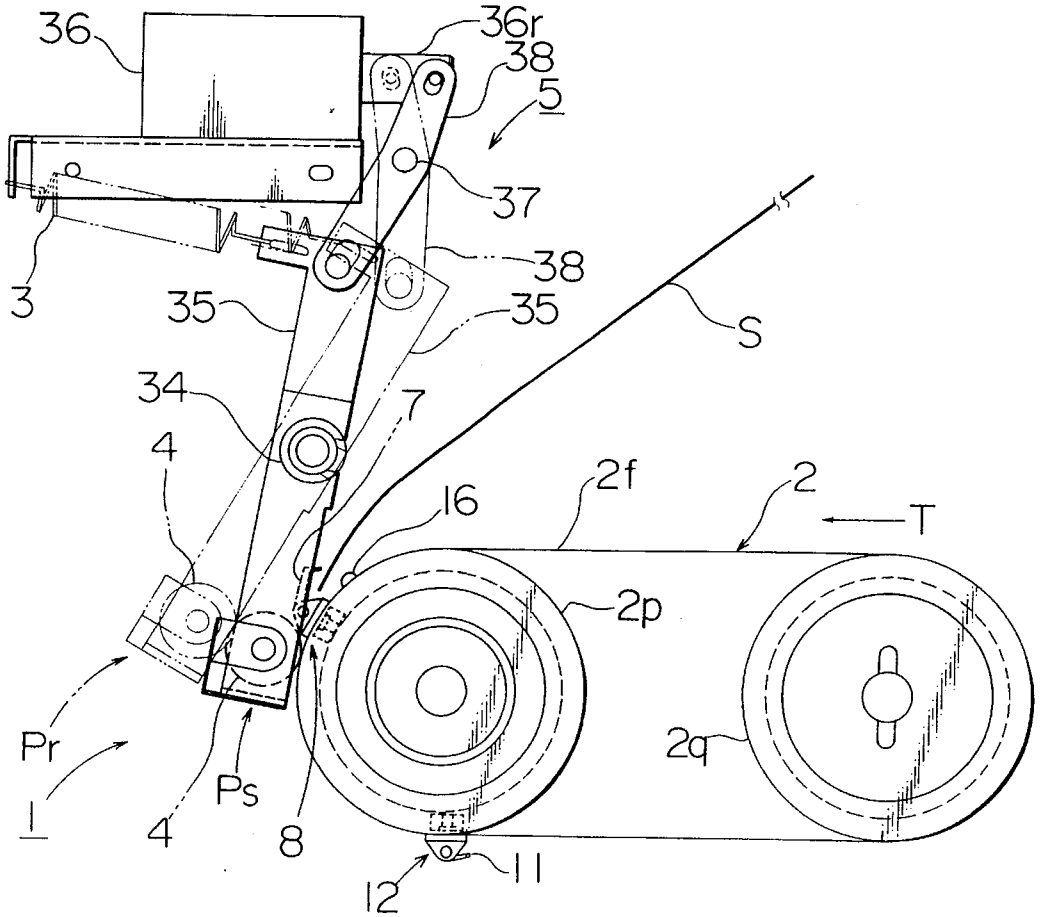
FIG. 1 is a constructional side view of a plate clamping apparatus of a printing mechanism according to the present invention.

On the other hand, as shown in FIG. 1, the operating mechanism 5 is arranged obliquely above the plate belt 2. The operating mechanism 5 is provided with a lever member 35 supported rotatably on a bearing portion 34 at an intermediate portion thereof, the freely rotatable roller 4 (operation portion) is supported rotatably on a lower portion of the lever member 35. In this case, one roller member may be used for the bearing portion 34, or a plurality (five in this embodiment) of roller members corresponding to the operated portions 7*m* . . . and 11*m* . . . are used therefore. A link member 38 supported rotatably on a bearing portion 37 at an intermediate portion thereof is arranged between the solenoid 36 and the lever member 35, the link member 38 is connected rotatably to the armature rod 36*r* of the solenoid 36 at an upper end thereof, and connected rotatably to the upper end of the lever member 35 at a lower end thereof. Further, one end of the spring member 3 is mounted on the upper end of the lever member 35 to thereby press the freely rotatable roller 4 in such a direction as to provide pressure-contact to the plate belt 2.

Thereby, when the armature rod 36*r* of the solenoid 36 is advanced and retreated, the freely rotatable roller 4 can be displaced selectively to the setting position Ps at which it is pressed to the surface 2*f* of the plate belt 2 and the releasing position Pr at which it is separated from the surface 2*f* of the plate belt 2. Accordingly, the freely rotatable roller 4 can be separated from the plate belt 2 against a resilient force of the spring member 3 at the setting position Ps.

An operation of the whole offset printing machine M including a movement of the plate clamping apparatus 1 according to this embodiment will be described hereinafter with respect to the drawings.

First, the plates S . . . are set on the plate tray 104. In this case, a print sheet on which a toner is printed by a laser printer, etc. is used for the plate belt 2. On the other hand, the plates S set on the plate tray 104 is charged automatically to the surface 2*f* of the plate belt 2. That is, at the time of the charging, the freely rotatable roller 4 of the operating mechanism 5 is displaced to the setting position Ps, so that the freely rotatable roller 4 is pressed by the spring member 3 to pressure-contact to the surface 2*f* of the plate belt 2. Accordingly, when the plate belt 2 is moved in the T direction in this state, and the fore clamps 7 . . . of the fore clamping mechanism 8 are caused to enter into the freely rotatable roller 4, the fore operated portions 7*m* . . . are sandwiched between the plate belt 2 and the freely rotatable roller 4, so that the fore clamps 7 . . . are pressed to the freely rotatable roller 4 to be displaced in a side of the plate belt 2. On this occasion, since the fore clamps 7 . . . are supported in a seesaw manner on the width directionwise supporting shafts 6 . . . disposed on the plate belt 2, the rear clamping portion 7*c* . . . are separated from the surface 2*f* of the plate belt 2. This state is shown by a solid line of FIG. 1, and by an imaginary line of FIG. 2.

Then, when the plates S supplied from the automatic plate charging mechanism B are inserted between the plate belt 2 and the clamping portions 7*c* . . . , and further advance the plate belt 2 and the plates S at the same speed, the fore clamps 7 . . . push aside the freely rotatable roller 4 by the spring member 3 to pass therethrough. As a result, after the fore clamps 7 . . . pass through the freely rotatable roller 4, the fore portion of the plates S is pressed by the spring member 9, and sandwiched and clamped between the clamping portion 7*c* and the surface 2*f* of the plate belt 2. Also, since the plates S clamped by the clamping portions 7*c* . . . are bent by the clamp assisting portion 16, it is clamped firmly. This case is shown by a solid line in FIG. 2.

On the other hand, when the plate belt 2 is advanced, the plate belt 2 is pressed by the freely rotatable roller 4, and charged in order into the surface 2*f* of the plate belt 2 so as not to realize the loosening. Then, when the rear portion of the plate S approaches the freely rotatable roller 4, the rear clamp 11 of the rear clamping mechanism 12 approaches thereto also, so that the operated portions 11*m* . . . of the rear clamp 11 are sandwiched between the surface 2*f* of the plate belt 2 and the freely rotatable roller 4. Thereby, the operated portions 11*m* . . . are pressed by the freely rotatable roller 4 to be displaced to a side of the plate belt 2. On this occasion, since the rear clamp 11 is supported in a seesaw manner by the width directionwise supporting shafts 10 . . . arranged at both left and right sides of the plate belt 2, the rear clamping portion 11*c* (rear clamping member 11*y*) is separated from the surface 2*f* of the plate belt 2. This case is shown by an imaginary line in FIG. 3. Incidentally, in this case, since the clamping portion 11*c* is rotation-displaced with the supporting shafts 10 . . . as a center, the rear end of the plates S can be entered into between the clamping portion 11*c* and the surface 2*f* of the plate belt 2, and after the rear clamp 11 passes through the freely rotatable roller 4, the rear portion of the plates S is pressed by the spring members 13 . . . and sandwiched and clamped between the clamping portion 11*c* rotation-displaced forward and the surface 2*f* of the plate belt 2. This state is shown by a solid line in FIG. 3.

Therefore, the plate belt 2 is charged automatically, onto the surface 2*f* of the plate belt 2, and the fore portion of the plates S is clamped by the fore clamping mechanism 8, and the rear portion of the plates S is clamped by the rear clamping mechanism 12, respectively. Then, at the time of finishing of the clamping step, if the freely rotatable roller 4 is displaced to the releasing position Pr shown by the imaginary line of FIG. 1, the freely rotatable roller 4 is separated from the surface 2*f* of the plate belt 2.

By the way, at the time of the charging of the plates S, simultaneously the etching treatment is carried out. In this case, a fourth roller 76 of an ink supplying mechanism F and a blanket belt 59 are separated from the plate belt 2, and a third roller 63 of a treating liquid supplying mechanism E are pressure-contacted to the plate belt 2, and then an etching liquid is supplied from an etching liquid supplying portion 68 to a first roller 61. Thereby, the etching liquid is spread thereon when the plates S passes through the third roller 63, and contamination and dust, etc. of the plates S are removed, then the hydrophilic property is raised.

Next, the step proceeds to the printing step. In the printing step, the fourth roller 76 of the ink supplying mechanism F, the blanket belt 59 and the third roller 63 of the treating liquid supplying mechanism E are pressure-contacted to the plate belt 2, respectively. Also, the humidifying water is supplied from the humidifying supplying portion 69 to the first roller 61. Thereby, when the plates S are advanced from the stand-by position, the humidifying water is spread from the third roller 63 to the plates S. On this occasion, the ink is fitted only to the image portion of the plates S. Then, the ink image on the plates S is transferred onto the surface of the blanket belt 59. On the other hand, in the printing mechanism G, the print sheet W is fed automatically to between the blanket belt 59 and a pressure-contacting roller 84, and the ink image of the blanket belt 59 is transferred to the print sheet W. Incidentally, such a printing step is repeated by the number of the print sheets.

Further, at the time of completion of the printing, the plates S charged to the plate belt 2 are discharged. At the time of the discharging, similar to the case of the charging, if the freely rotatable roller 4 is pressure-contacted to the surface 2*f* of the plate belt 2, the clamping portions 7*c* . . . are separated from the plate belt 2, so it is enough that the plates S are picked up by the paddle roller 55 of the automatic plate discharging mechanism C, and further the plates S are transferred by a plate discharging mechanism 56. Thereby, the plates S are pulled, so that the rear portion of the plates S are extracted from the rear clamp 11, and collected to the plate collecting tray 105. On the other hand, the residue ink of the blanket belt 59 is removed by a cleaning mechanism H.

By the way, since the plate belt 2 is used for the plate carrier in this embodiment, there is a fear that, in a case where the plate belt 2 is thick, the plates S are pulled by a curved surface portion when the plates S are engaged with the pulley 2*p*, and the loosening is caused on the plates S due to the reaction thereof after the pulley 2*p* passes therethrough. Accordingly, in a case where there is a fear that the loosening is caused on the plate S, it is desirable to provide for preventing the loosening or a loosening influence preventing function portion for preventing a loosening influence as occasion demands, to thereby prevent a bad influence due to the loosening caused on the plates S which influences the print quality.

Figure 7:
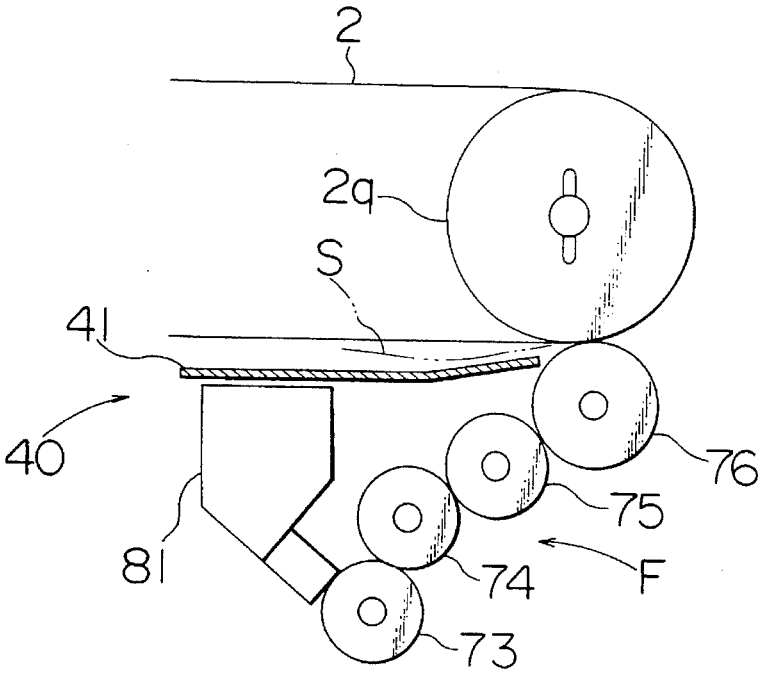
FIG. 7 is a diagrammatic constructional view of a loosening preventing function portion provided with the plate clamping apparatus.

FIG. 7 shows the loosening influence preventing function portion 40 for preventing a bad influence to the plates S. The loosening influence preventing function portion 40 is provided with a shielding plate 41 arranged between the plate belt 2 and the ink supplying mechanism F, thereby a bad influence is prevented wherein the loosened plate S contacts to the roller of the ink supplying mechanism F.

Figure 8:
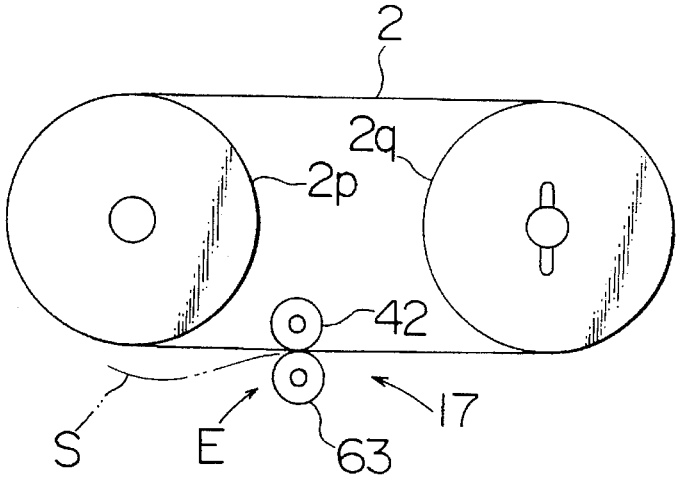
FIG. 8 is a diagrammatic constructional view of another loosening preventing functioning portion provided with the plate clamping apparatus.

Also, FIG. 8 shows the loosening preventing function portion 17 for preventing the loosening of the plates S. The loosening preventing function portion 17 is constituted by arranging the third roller 63 for spreading the treating liquid to the plates S of the treating liquid supplying mechanism E, on the plate belt 2 which has passed through the pulley 2*p*, and disposing the pressing roller 42 opposing to the third roller 63. Thereby, the plates S are prevented from loosening by passing the plate belt 2 between the pressing roller 42 and the third roller 63.

Figure 9:
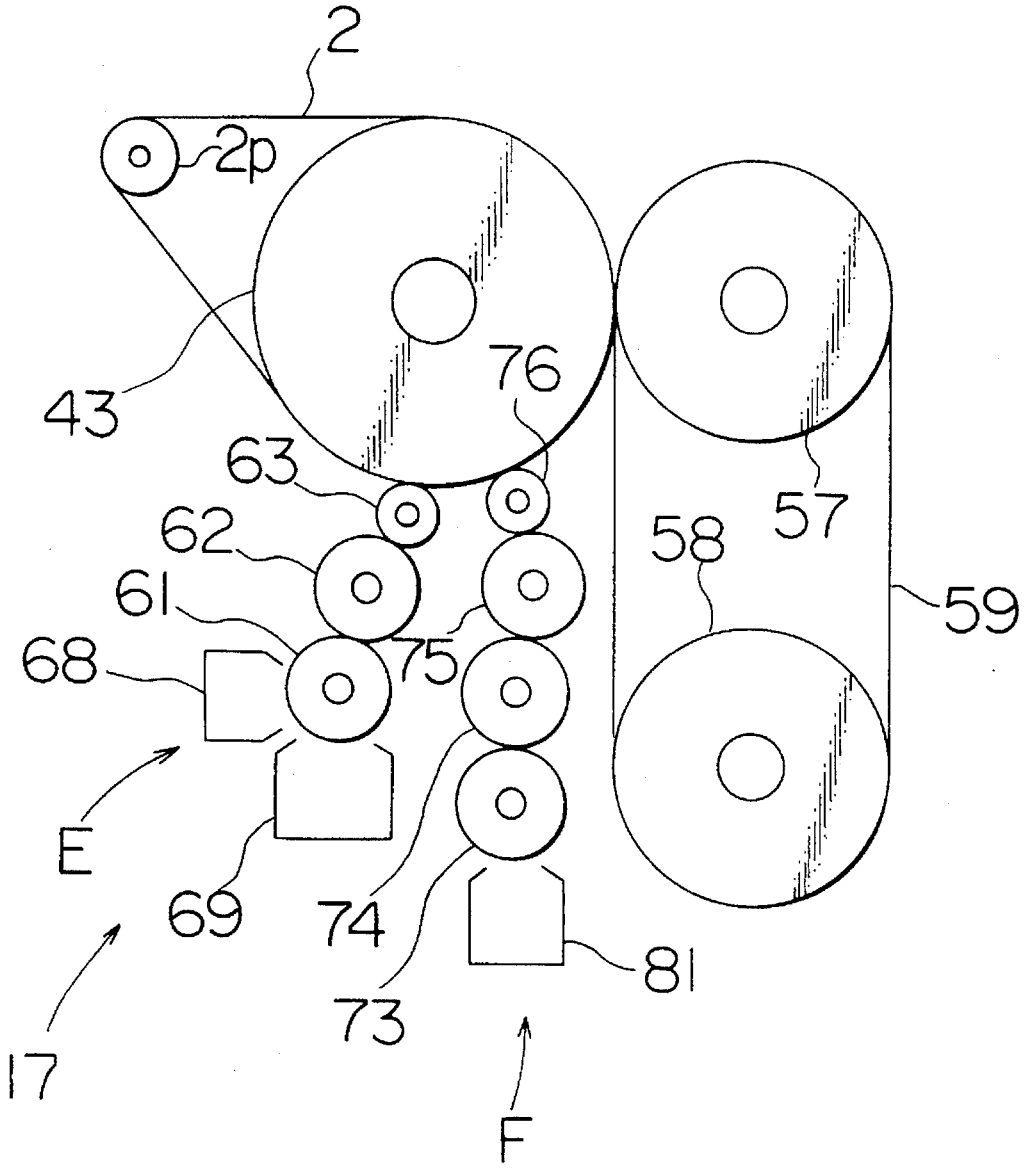
FIG. 9 is a diagrammatic constructional view of another loosening preventing functioning portion provided with the plate clamping apparatus.

Furthermore, FIG. 9 shows a loosening preventing function portion 17 of another construction. This loosening preventing function portion 17 is so adapted that the third roller 63 of the treating liquid supplying mechanism E and the fourth roller 76 of the ink supplying mechanism F can be pressure-contacted to the plate belt 2 engaged with the circumferential surface of the rear pulley 43. Thereby, relative loosening is not caused to the plates S of the plate belt 2 before the loosening of the ink. In this way, the loosening of the plates S can be prevented by providing the loosening preventing function portion 17 as occasion demands. Incidentally, in FIGS. 7 to 9, the same reference numeral is given to the same component as that of FIG. 5, so that the construction thereof is clarified.

As described above, the embodiment has been described in detail, however, the present invention is not limited to such an embodiment. For example, the plate carrier is exemplified as the plate belt, however, a general cylindrical printing drum can be applied thereto similarly. Also, the operating portion is exemplified as the freely rotatable roller, however, a plate member, etc. having a small friction coefficient can be used. Furthermore, the rear clamping mechanism may be formed in a shape in which a fore and a rear portion of the exemplified shape are switched, that is, a shape in which the rear clamping member are arranged in a moving direction of the plate carrier. Otherwise, in detail construction, shape, number, material and the like, it may be changed on occasion without departing from the spirit and the scope of the present invention.

We claim:

1. A plate clamping apparatus of a printing machine for clamping a plate to a surface of a plate carrier, characterized in that the apparatus comprises:

an operating mechanism having an operating portion which is displaced to a setting position for pressure-contacting to the plate carrier by a spring member and a releasing position for separating from the plate carrier;

a fore clamping mechanism supported in a seasaw manner on a widthwise supporting shaft disposed on the plate carrier, and having clamping portions for clamping a fore portion of the plate at one end thereof, operated portions pressed by the operating portion at the setting position, at the other end thereof, and fore clamps pressed in a clamping direction by spring members; and a rear clamping mechanism supported in a seasaw manner on a widthwise supporting shaft disposed on the plate carrier at a rear of the fore clamping mechanism, and having a clamping portion for clamping a rear portion of the plate at one end thereof, operated portions pressed by the operating portion located at the setting position, at the other end thereof, and a rear clamp pressed in a clamping direction by spring members.

2. A plate clamping apparatus of a printing machine according to claim 1, characterized in that the plate carrier is a pair of endless plate belts hung on between pulleys spaced from each other.

3. A plate clamping apparatus of a printing machine according to claim 1, characterized in that the operating portion is a freely rotatable roller.

4. A plate clamping apparatus of a printing machine according to claim 1, characterized in that the fore clamping mechanism is provided with a plurality of fore clamps supported by the supporting shaft positioned at an inner position of the plate from left and right end positions thereof.

5. A plate clamping apparatus of a printing machine according to claim 1, characterized in that the rear clamping mechanism is provided with a rear clamp having a U-like portion comprising a pair of left and right lateral clamping members and a rear clamping member, and supported by a pair of left and right supporting shafts positioned at an outer side of the plate from left and right end positions thereof at respective lateral clamping members, the rear clamping member functioning as a clamping portion being arranged rearward in a moving direction of the plate carrier.

6. A plate clamping apparatus of a printing machine according to claim 1, characterized in that a protruding clamp assisting portion for bending the plate clamped by the clamping portion is disposed on a surface of the plate carrier approaching the clamping portion and is rearward of the clamping portion of the fore clamp.

7. A plate clamping apparatus of a printing machine according to claim 1, characterized in that the apparatus is provided with a looseness preventing functioning portion for preventing a looseness of the plate.

8. A plate clamping apparatus of a printing machine according to claim 1, characterized in that the apparatus is provided with an automatic plate charging mechanism for inserting the plate contained in a plate tray between the clamping portion of the fore clamping mechanism and the plate carrier, at the setting position, and advancing the plate at the same speed as that of the plate carrier.

9. A plate clamping apparatus of a printing machine according to claim 1, characterized in that the apparatus is provided with an automatic plate discharging mechanism for picking up the plate charged to the plate carrier to discharge the plate at the setting position.

10. A plate clamping apparatus of a printing machine according to claim 2, characterized in that the operating portion is a freely rotatable roller.

11. A plate clamping apparatus of a printing machine according to claim 2, characterized in that the fore clamping mechanism is provided with a plurality of fore clamps supported by the supporting shaft positioned at an inner position of the plate from left and right end positions thereof.

12. A plate clamping apparatus of a printing machine according to claim 3, characterized in that the fore clamping mechanism is provided with a plurality of fore clamps supported by the supporting shaft positioned at an inner position of the plate from left and right end positions thereof.

13. A plate clamping apparatus of a printing machine according to claim 2, characterized in that the rear clamping mechanism is provided with a rear clamp having a U-like portion comprising a pair of left and right lateral clamping members and a rear clamping member, and supported by a pair of left and right supporting shafts positioned at an outer side of the plate from left and right end positions thereof at respective lateral clamping members, the rear clamping member functioning as a clamping portion being arranged rearward in a moving direction of the plate carrier.

14. A plate clamping apparatus of a printing machine according to claim 3, characterized in that the rear clamping mechanism is provided with a rear clamp having a U-like portion comprising a pair of left and right lateral clamping members and a rear clamping member, and supported by a pair of left and right supporting shafts positioned at an outer side of the plate from left and right end positions thereof at respective lateral clamping members, the rear clamping member functioning as a clamping portion being arranged rearward in a moving direction of the plate carrier.

15. A plate clamping apparatus of a printing machine according to claim 2, characterized in that a protruding clamp assisting portion for bending the plate clamped by the clamping position is disposed on a surface of the plate carrier approaching the clamping portion and is rearward of the clamping portion of the fore clamp.

16. A plate clamping apparatus of a printing machine according to claim 3, characterized in that a protruding clamp assisting portion for bending the plate clamped by the clamping position is disposed on a surface of the plate carrier approaching the clamping portion and is rearward of the clamping portion of the fore clamp.

17. A plate clamping apparatus of a printing machine according to claim 4, characterized in that a protruding clamp assisting portion for bending the plate clamped by the clamping position is disposed on a surface of the plate carrier approaching the clamping portion and is rearward of the clamping portion of the fore clamp.

* * * * *